US006374427B1

(12) United States Patent
Tash

(10) Patent No.: US 6,374,427 B1
(45) Date of Patent: Apr. 23, 2002

(54) DRAIN PLUNGER

(76) Inventor: George Tash, 5777 Balcolm Cangon, Somis, CA (US) 93021

( * ) Notice: Subject to any disclaimer, the term of this patent is extended or adjusted under 35 U.S.C. 154(b) by 486 days.

(21) Appl. No.: 08/677,707

(22) Filed: Jul. 10, 1996

Related U.S. Application Data

(63) Continuation-in-part of application No. 08/416,108, filed on Apr. 3, 1995, now abandoned.

(51) Int. Cl.[7] ..... E03D 11/00
(52) U.S. Cl. ..... 4/255.11
(58) Field of Search ..... 4/255.11, 255.12

(56) References Cited

U.S. PATENT DOCUMENTS 1,152,981 A * 9/1915 Schacht ..... 4/255.11
1,154,055 A * 9/1915 Reeves ..... 4/255.12
2,846,698 A * 8/1958 Tomlinson ..... 4/255.11
4,745,641 A * 5/1988 Tash ..... 4/255.11

* cited by examiner

*Primary Examiner*—Robert M. Fetsuga

(74) *Attorney, Agent, or Firm*—Lyon & Harr; Mark A. Watson

(57) ABSTRACT

The drain plunger preferably is of one-piece preferably plastic construction, with an upstanding, preferably vertical, rigid upper handle, the lower end of which is connected integrally to a depending multi-pleated, flexible, resilient bellows having an elastic memory. The bellows includes a small diameter upper end and downwardly diverging, frusto-conical sidewalls, the latter incorporating generally horizontally extending generally vertically stacked pleats and an open lower end terminating in a sealing rim of greater diameter than the top of the bellows. The bellows defines a central space. The rim is generally planar and preferably cyclindrical, curving in its relaxed state downwardly and inwardly from its outer margin to its inner margin, the latter curving upwarding during compression of the bellows against a surface and curving downwardly during urging upwardly of the handle after compression of the bellows rim against a surface to increase the sealing force of the plunger and its suction relative to that surface. Preferably, the pleats exhibit progressively increasing flexibility from the top to the bottom pleat and rim. The handle of the plunger can be formed of high density polyethylene plastic and the bellows can be formed of progressively varying proportion of low density polyethylene plastic and ethylene-vinyl acetate copolymer.

12 Claims, 2 Drawing Sheets

DRAIN PLUNGER

This is a continuation-in-part of U.S. patent application Ser. No. 08/416,108, filed Apr. 3, 1995, abandoned.

BACKGROUND OF THE INVENTION

1. Field of the Invention

The present invention generally relates to drain-clearing devices and more particularly to improved drain plungers.

2. Prior Art

Various types of devices have been used in the past to clear water and sewage drains of clogs. One well-known type utilizes a spirally coiled "snake" which is fed down the drain hole and rotated to force obstructions from the drain. Such devices have been known to damage drain pipes and are not used unless severe clogging occurs, and then only usually by professionals.

Another type of drain-clearing device comprises an inverted, relatively stiff, thick rubber cup to the top of which is connected a wood or metal vertical handle. Although such a device is effective in many instances to clear certain types of drains, it has a serious drawback, in that the cup is initially very difficult to compress or collapse and then suddenly rapidly compresses, causing a very forceful surge in the drain, sometimes forcing drain pipe connections apart and causing drain pipe leaks. Moreover, the cup is not well adapted for use with various types of drains.

More exotically shaped drain plungers are exemplified by U.S. Pat. Nos. 2,188,960 and 2,844,826. In most cases, commercially available drain plungers and similar devices have poor sealing power with the surface surrounding the drain hole and therefore such plungers are unable to provide the necessary controlled compressive and suction force needed to clear clogged drains.

A toilet drain plunger of an improved type is set forth in U.S. Pat. No. 4,745,641 to Tash, inventor of the present claimed plunger. The reference Tash plunger incorporates a durable bottom ring seal, which is relatively inflexible, and is designed to engage the bottom surface defining the bottom drain hole in a toilet bowl, the lower end of the plunger fitting into that hole, while an upper annular shoulder of the plunger bottom portion engages the upper surface defining that drain hole. Drain unclogging is effected by both the compression and suction portions of the plunger compression-suction cycle. Although that plunger is desirably designed for unclogging toilet drains, it is less efficient on other types of drains, including sink drains and the like surrounded by flat surfaces.

SUMMARY OF THE INVENTION

The improved drain plunger of the present invention satisfies all the foregoing needs. Thus, a drain plunger is provided which is compact, simple, inexpensive, easy to use and highly efficient. It seals readily to a variety of surfaces defining drain holes of differing sizes and shapes and imparts a powerful but controlled suction to the drains after readily sealing the drain holes so as to enable rapid clearance of drains of obstructions. Compression of the plunger is easily carried out without damaging the drain plumbing and with relatively little effort.

The plunger is substantially as set forth in the ABSTRACT OF THE DISCLOSURE. Thus, an improved drain plunger is provided which preferably is formed in a single molding operation of a mixture of plastics having differing degrees of resilience, flexibility, elastic memory and rigidity. For example, the plunger can comprise a generally upstanding elongated stiff handle of high density polyethylene or other plastic and a lower bellows portion with integral bottom sealing rim, the bellows portion comprising a mixture of low density polyethylene plastic and ethylene-vinyl acetate copolymer, wherein the mixture is varied progressively to import an improved compressibility and drain sealability to the bellows of the plunger.

The bellows of the plunger is generally frusto-conical and comprises a narrow diameter top sealed to the lower end of the handle and annular sidewalls depending downwardly and outwardly to define a central space and the bottom sealing rim which has a diameter substantially larger than that of the top. The sidewalls comprise a plurality of generally horizontal, interconnected vertically stacked pleats which easily collapse on each other during compression of the bellows.

The lower rim of the plunger is of special configuration and integral with the lowermost pleat of the sidewalls of the bellows. Thus, the rim comprises a downwardly and inwardly directed wall, the inner margin of which defines the central opening in the plunger bottom. The inner margin of the rim is forced sightly inwardly and upwardly during compression of the bellows against a drain hole-bearing surface to create a good seal. When the handle of the plunger is pulled up after compression of the bellows against the drain hole surface, the inner margin of the sealing rim moves downwardly and slightly outwardly to increase very strongly its engagement with such surface, greatly improving the sealing effect of the rim and thus greatly improving the suction effect exerted by the plunger for more rapid and efficient drain clearance. This is a vast improvement over prior art plungers utilizing lower rims which are relatively inflexible and/or which largely depend on a compressive action to effect clogging of drains.

The present device substantially differs in shape, sealing mode and operation from the plunger of the Tash patent described above. Thus, the present claimed plunger employs a bellows which is frusto-conical with a narrow diameter top and wide diameter bottom so as to fit a wide range of configurations and sizes of drain holes. Moreover, the bellows, including the lower rim, is formed of material which, during such formation, is varied in content in order to progressively increase the flexibility of the bellows from its top to bottom for easier operation of the bellows. In addition, the lower rim of the bellows curves inwardly and upwardly and changes shape and direction during compression of the bellows and when decompression of the bellows is begun to increase suction on the drain hole. This results in improved suction and more rapid, non-damaging clearance of drain clogs. The main declogging occurs during the strong suction provided by the plunger, rather than depending on alternating compression and suction for results.

DRAWINGS

DETAILED DESCRIPTION

Figure 1:
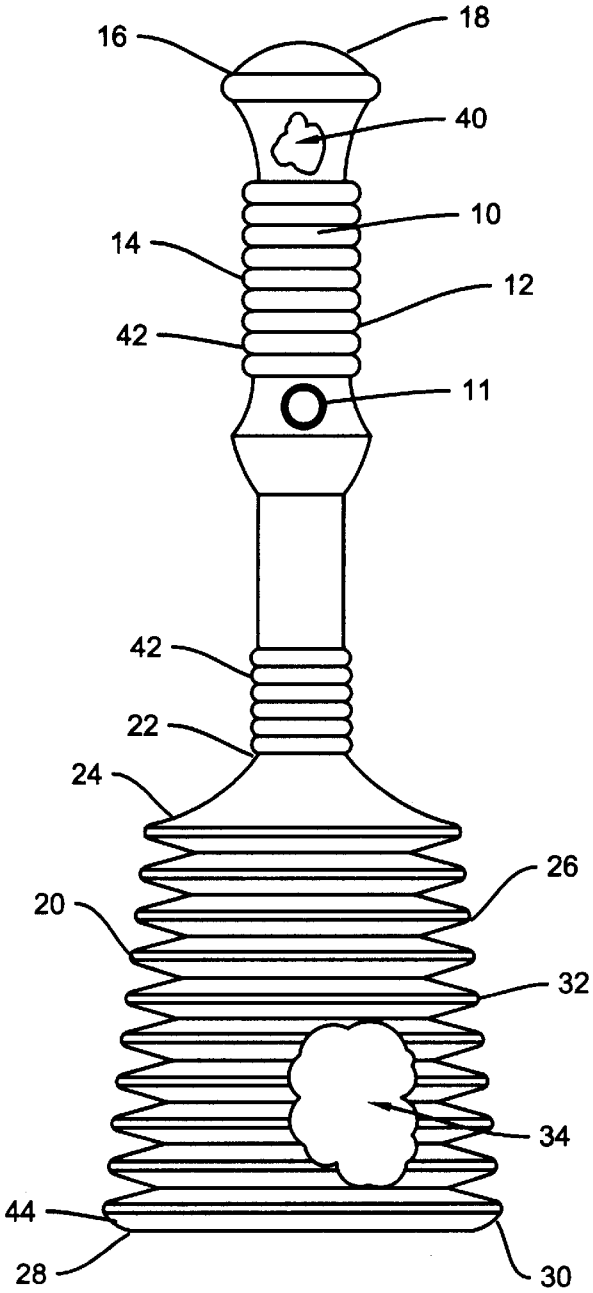
FIG. 1 is a schematic side elevation, partly broken away, of a preferred embodiment of the improved drain plunger of the present invention, shown with the bellows of the plunger in a relaxed uncompressed state.

FIGS. 1–6.

Now referring more particularly to the accompanying drawings, a preferred embodiment of the improved drain plunger of the present invention is schematically depicted therein.

Thus, drain plunger 10 is shown. Plunger 10 comprises a unitary body 12 having an upstanding, preferably vertical, stiff elongated handle 14 terminating at its upper end 16 in an expanded knob 18 which is adapted to fit the palm of the hand of the user of plunger 10. Handle 14 preferably is hollow, as is the bellows 20 integrally connected to the lower end 22 of handle 14 and depending therebelow.

Bellows 20 is generally frusto-concial, having an upper generally horizontal small diameter end 24 integrally connected to sidewalls 26 which diverge downwardly therefrom and terminate at the open, greater diameter lower end 28 thereof in a generally planar or horizontally extending integral annular bottom rim 30. Sidewalls 26 are pleated, that is, comprise a vertically stacked series of interconnected horizontally extending integral pleats 32. Bottom rim 30 is integral with the lowermost of pleats 32. Upper end 24 and sidewalls 26 collectively define a central space 34 communicating with open lower end 28.

Figure 2:
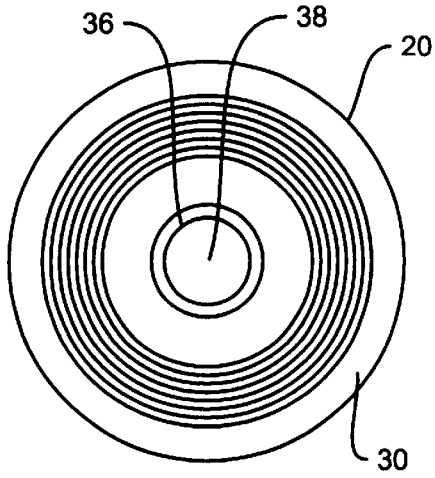
FIG. 2 is a reduced schematic bottom plan view of the plunger of FIG. 1.

For structural integrity upper end 24 of bellows 20 may include an internal transverse wall 36 (FIG. 2) having an opening 38 communicating with the central space 38 in handle 14. Plunger 10 may include a one-way flap valve 11 or the like in handle 14 to provide easy escape of air from bellows 20 during compression of bellows 20 or can depend on the special configuration of rim 30 for such air escape.

Handle 14 is of relatively stiff and inflexible material, such as high density polyethylene plastic which can be inexpensively molded and which is light in weight. Handle 14 can include a plurality of stiffening rings 42 which can be integrally molded as part of handle 14.

Bellows 20, including its lower rim 30, is formed of relatively flexible, resilient material with an elastic memory. For such purposes it is preferred to utilize a mixture of relatively low density polyethylene plastic and a minor concentration, for example, about 3–4 weight percent, of a copolymer of ethylene and vinyl acetate. Other plastics, rubbers and the like could be used for all of bellows 20, including rim 30. It will be understood that rim 30 forms an integral part of bellows 20 and that handle 14 , and bellows 20, with its rim 30, can be formed inexpensively and simultaneously in a single molding operation by conventional molding techniques to provide the light weight efficient plunger 10.

Rim 30 is specially configured to provide an improved result. Rim 30 comprises an annular wall 44 integrally joined to the lowermost of pleats 32 of sidewalls 26, as previously described and thus forming an integral part of bellows 20. Wall 44 in the relaxed state curves downwardly and inwardly, as shown in FIG. 4, with the inner margin 46 thereof medial of the outer margin 48 thereof.

Figure 3:
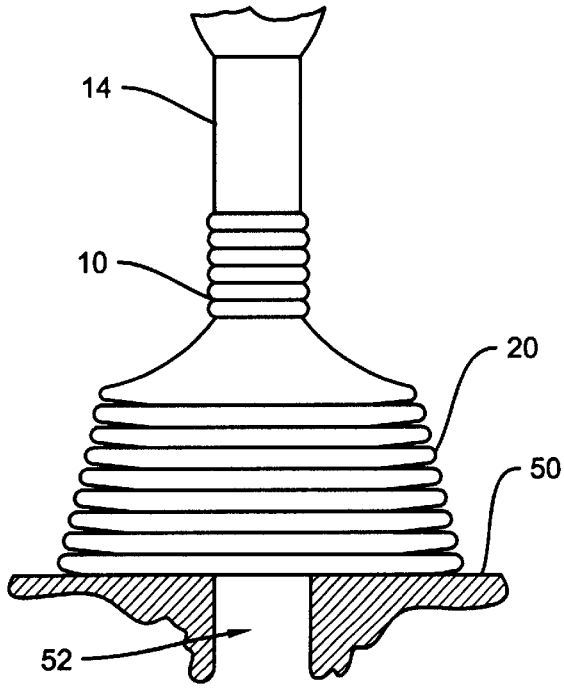
FIG. 3 is a schematic side elevation of the plunger of FIG. 1, shown with the bellows of the plunger fully compressed against a surface defining a drain hole.
Figure 4:
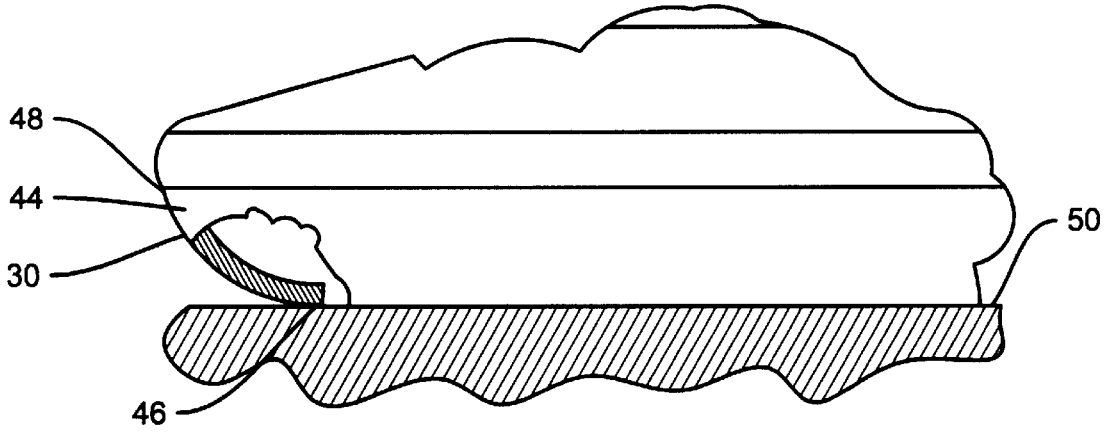
FIG. 4 is an enlarged fragmentary side elevation, partly broken away and partly in section, showing the rim of the plunger bellows in the relaxed state.
Figure 5:
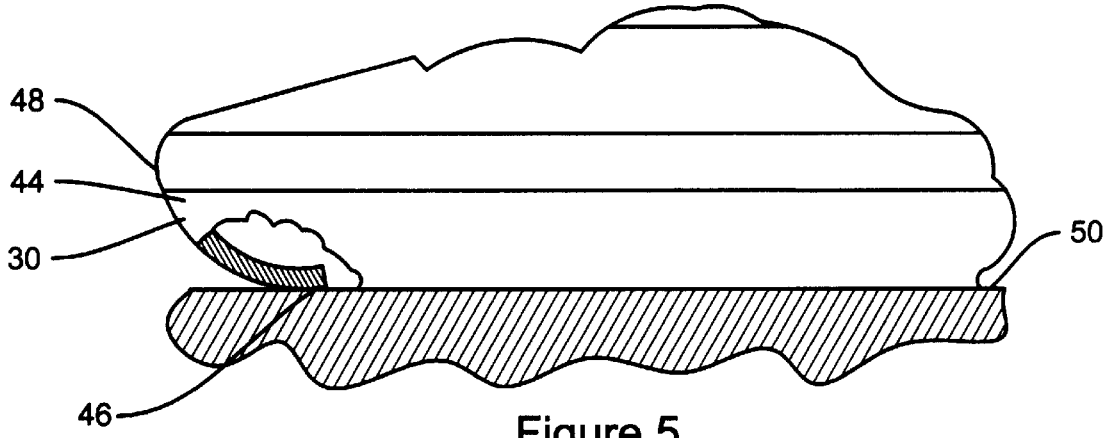
FIG. 5 is an enlarged fragementary side elevation, partly broken away and partly in section, showing the rim of the plunger bellows during partial compression of the rim; and, FIG. 6 is an enlarged fragmentary side elevation, partly broken away and partly in section, showing the rim of the plunger bellows fully compressed.
Figure 6:
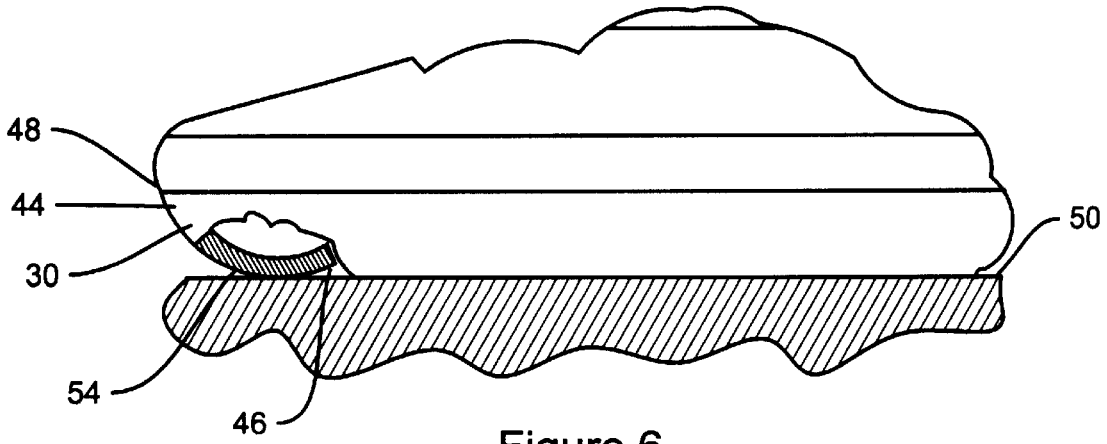

When rim 30 is pressed down on a surface 50 defining a drain hole 52 (FIG. 3), as by pushing down on handle 14 to collapse bellows 20 so that pleats 32 nest (FIG. 3), rim 30 moves from the uncompressed configuration of FIG. 4, through the partially compressed configuration of FIG. 5, wherein inner margin 46 begins to move or roll inwardly and upwardly, to the fully compressed configuration of FIG. 6, wherein inner margin 46 is well above surface 50 and only the medial portion 54 of wall 44 is mashed against surface 50.

During this progressive movement air can escape from space 34 through rim 30 and permit the full compression of plunger 10. However, when it is desired to provide the drain clog-loosening action of suction, handle 14 is then pulled up and the sealing action of rim 30 takes effect, driving inner margin 46 tightly downwardly against surface 50 so as to increase the contact area of wall 44, improve the seal between bellows 20 and surface 50 and thus improve the suction afforded by plunger 10. The net result is a controlled but stronger suction and more rapid and efficient dislodging of drain clogs.

Another feature of plunger 10 is that the flexibility and resiliency of pleats 32 varies progressively, with the lowermost pleats 32 the most flexible and most resilient and the uppermost pleats 32 the least flexible and least resilient. Moreover, rim 30, which is integral with the lowermost pleat 32, can be more flexible and resilient than said lowermost pleat 32. This feature can be built into bellows 30 during the molding operation by progressively varying the concentration of ingredients forming bellows 20 and/or by varying the size, thickness and configuration of the various pleats 32 and rim 30 in bellows 20. The net result is that bellows 20 smoothly and progressively compresses, avoiding the sudden compression surge normally encountered when "plumber's helpers" having thick walled relatively inflexible non-pleated rubber cups are used. Damage to the drain pipes is thus avoided, as well as strain on the user of plunger 10. It will be noted that the main unclogging function of plunger 10 takes place during the suction portion of the compression-suction cycle, in contrast to many conventional drain plungers, which depend on forceful compression to drive clogs down into the drain, unfortunately risking drain plumbing damage in the process. With the plunger of the present invention, clogs are easily removed without any damage to the plumbing.

Further advantages and features of plunger 10 are as set forth in the foregoing. Various modifications, changes, alterations and additions can be made in the improved drain plunger of the present invention, its components and parameters. All such changes, modifications, alterations and additions as are within the scope of the appended claims form part of the present invention.

What is claimed is:

1. A drain plunger for creating a suction force within a drain, said plunger comprising:

a) a handle;

b) a bellows coupled to the handle; and c) a flexible annular sealing rim coupled to the base of the bellows, the sealing rim defining a central space which opens to the interior of the bellows, and wherein the sealing rim is capable of allowing air to escape from the interior of the bellows during compression of the bellows.

2. The plunger of claim 1 wherein said handle and bellows are of one piece construction.

3. The plunger of claim 1 wherein said handle and bellows are of plastic.

4. The plunger of claim 1 wherein said handle is hollow and formed of substantially inelastic plastic.

5. The plunger of claim 1 wherein said handle and bellows are formed of different types of plastic.

6. The plunger of claim 1 wherein said handle further comprises an expanded knob coupled to the top of the handle.

7. The plunger of claim 1 wherein said handle is formed of high density polyethylene plastic while said bellows is formed of low density polyethylene plastic.

8. The plunger of claim 1 wherein the bellows is comprised of a plurality of horizontally extending pleats which progressively vary in flexibility, the most flexible of said pleats being at the lower end of said plunger and the least flexible of said pleats being at the upper end of said bellows for proper nesting of said pleats during compression of said bellows and wherein said rim has a flexibility greater than the lowermost of said pleats.

9. The plunger of claim 1 wherein the handle is hollow, having a central space which is in fluid communication with the interior of the bellows.

10. The plunger of claim 1 wherein the suction force is created within the drain as the handle is pulled upwards following compression of the bellows with the sealing rim in contact with a surface surrounding a drain opening.

11. The plunger of claim 1 wherein the sealing rim is downwardly and inwardly curved, and wherein the inner margin of the sealing rim has the capability to flex upwardly and inwardly during compression of the bellows against a surface surrounding a drain opening.

12. The plunger of claim 11 wherein the inner margin of the rim is capable of deforming downwardly from the upwardly and inwardly curved position assumed during bellows compression to increase the sealing contact between the rim and the surface against which the rim is compressed.

* * * * *